US005437543A

United States Patent [19]

Goto et al.

[11] Patent Number: 5,437,543

[45] Date of Patent: Aug. 1, 1995

[54] SCROLL TYPE REFRIGERANT COMPRESSOR WITH MEANS FOR IMPROVING AIRTIGHT SEALING OF COMPRESSION CHAMBERS

[75] Inventors: Kunifumi Goto; Shinya Yamamoto; Tetsuhiko Fukanuma; Yasushi Watanabe; Kiyohiro Yamada, all of Kariya, Japan

[73] Assignee: Kabushiki Kaisha Toyoda Jidoshokki Seisakusho, Aichi, Japan

[21] Appl. No.: 157,829

[22] Filed: Nov. 24, 1993

[30] Foreign Application Priority Data

Nov. 26, 1992 [JP] Japan ..... 4-317101
Mar. 31, 1993 [JP] Japan ..... 5-073376

[51] Int. Cl.[6] ..... F01C 1/04

[52] U.S. Cl. ..... 418/55.5; 418/57; 418/151

[58] Field of Search ..... 418/55.1, 55.5, 57, 418/151

[56] References Cited

U.S. PATENT DOCUMENTS 4,764,096 8/1988 Sawai et al. ..... 418/55
4,824,346 4/1989 Hiraga et al. .
5,145,346 9/1992 Iio et al. ..... 418/55.5
5,199,862 4/1993 Koudo et al. ..... 418/55.1

FOREIGN PATENT DOCUMENTS 2176179 7/1990 Japan .
450489 2/1993 Japan .

*Primary Examiner*—Richard A. Bertsch
*Assistant Examiner*—Charles G. Freay
*Attorney, Agent, or Firm*—Burgess, Ryan & Wayne

[57] ABSTRACT

A scroll type refrigerant compressor having a stationary scroll unit, a movable scroll unit including an orbiting spiral member engaged with the stationary scroll unit to define variable-volume compression chambers in which the refrigerant gas is compressed in response to a rotation of a drive shaft having an eccentrically arranged drive key member, and a drive bushing member having an aperture formed therein in which the drive key of the drive shaft is inserted so as to cause an eccentric motion of the drive bushing member operatively engaged with the movable spiral member to thereby drive an orbiting motion of the movable spiral member. The drive key member is formed as an axial columnar mechanical member having a central axis thereof parallel with the axis of rotation of the drive shaft and a diametrical axis thereof intercrossing the central axis at a predetermined point, the diametrical axis of the drive key member being arranged so as to be angularly shifted by a predetermined angle in a direction reverse to the rotating direction of the drive shaft with regard to a predetermined axis passing through the axis of rotation of the drive shaft, the predetermined point of the drive key member being arranged in an area extending in a direction reverse to the rotating direction of the drive shaft with regard to a line connecting the axis of rotation of said drive shaft and the central axis of said drive bushing member, the drive key member further having planar faces disposed on both sides of the diametrical axis thereof, and two spaced ends, each of the two spaced ends being distant from the central axis of the drive shaft.

5 Claims, 12 Drawing Sheets

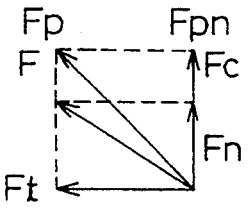
Fig. 18
(PRIOR ART)
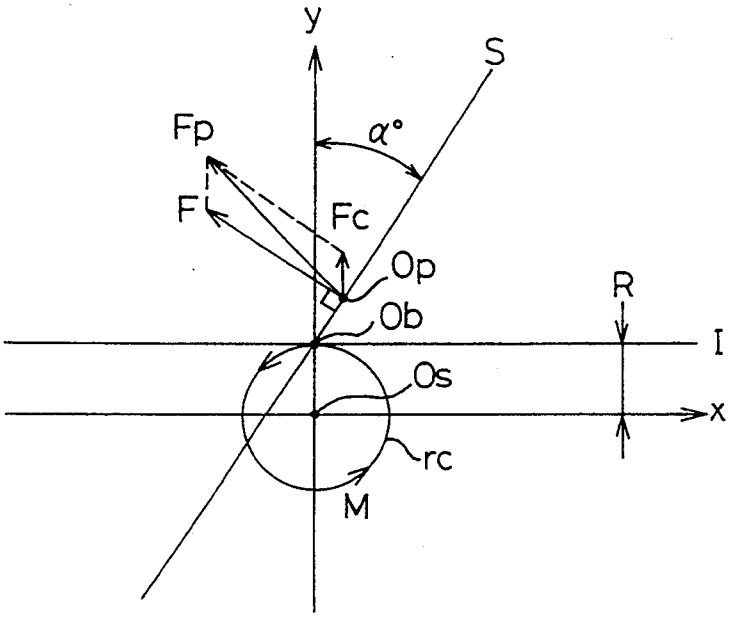
Fig. 19
(PRIOR ART)
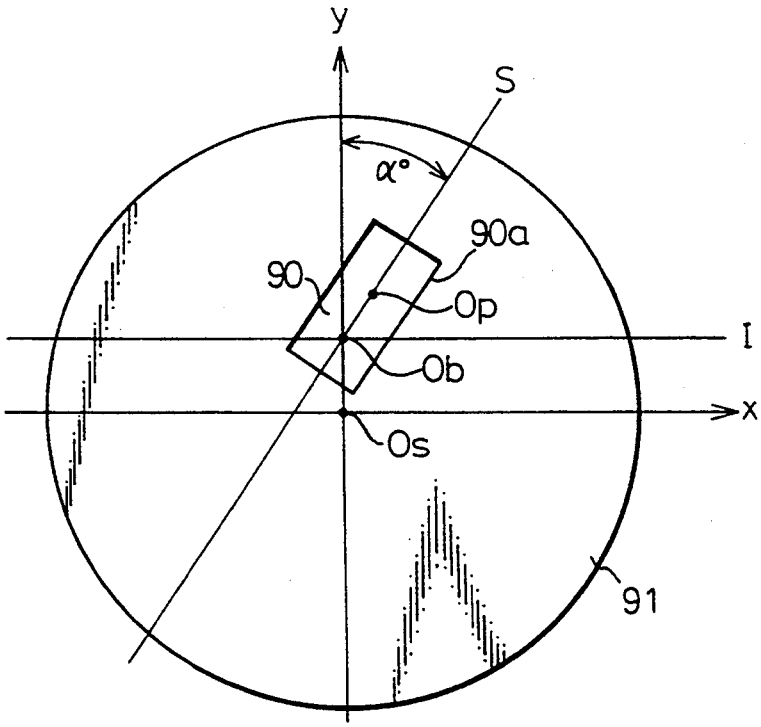

SCROLL TYPE REFRIGERANT COMPRESSOR WITH MEANS FOR IMPROVING AIRTIGHT SEALING OF COMPRESSION CHAMBERS

FIELD OF THE INVENTION

The present invention relates to a scroll type refrigerant compressor, and more particularly, relates to an improvement of a drive key member accommodated in a compression drive mechanism of the compressor.

DESCRIPTION OF THE RELATED ART

Japanese Unexamined Patent Publication (Kokai) No. 2-1761 79 discloses a typical scroll type refrigerant compressor provided with a stationary scroll unit fixedly encased in a housing means, and a movable scroll unit orbiting in the housing means so as to compress refrigerant gas in cooperation with the stationary scroll unit. The stationary scroll unit includes a stationary spiral member and an end plate member fixedly attached to an end of the spiral member and to the housing means.

The stationary spiral member is formed as a wall member extending spirally along an involute curve with respect to a given point, i.e., a center of the stationary spiral member.

The movable scroll unit includes a movable spiral member engaged with the stationary spiral member and a movable end plate member fixed to an end of the movable spiral member on the side axially opposite to the end plate member of the stationary scroll unit. The movable spiral member, which is also formed as a wall member extending spirally along an involute curve with respect to a given point, i.e., a center of the movable spiral member is arranged so as to be circumferentially shifted from the stationary spiral member by 180°.

The scroll type refrigerant compressor is also provided with an axial drive shaft rotatably supported in the housing means and having a large diameter portion formed at an end thereof. The large diameter portion of the drive shaft is provided with an integral drive key member projecting axially from the end face thereof.

The drive key member is formed as a partialy-cylindrical member having a central axis thereof "Op" which is shifted from the center of rotation "Os" of the drive shaft as shown in FIG. 18. The drive key member is provided with opposite planar faces extending in parallel with the central axis "Op" and two diametrically opposed circular faces. The planar faces of the drive key member are arranged on opposite sides with regard to a diametrical axis "S" of the key member which extends perpendicularly to the above-mentioned central axis "Op" while passing the above-mentioned central axis "Op".

The diametrical axis "S" of the drive key member is inclined by an angle "$\alpha$" in a reverse direction to the direction of rotation "M" of the drive shaft from a predetermined diametrical axis (Y-axis of FIG. 18) passing through the axis of rotation "Os" of the drive shaft.

The above-mentioned bushing member having a central axis "Ob" thereof is provided with an aperture into which the drive key member of the drive shaft is inserted in a manner such that the drive key member is able to slide in the diametrical axis "S" thereof. The bushing member is engaged with the movable spiral member of the movable scroll unit via a bearing element so as to move the movable scroll unit in an orbiting path with regard to the stationary scroll unit. The movable scroll unit is, however, prevented from being rotated about the central axis thereof by an appropriate rotation preventing means such as described in U.S. Pat. No. 4,824,346.

The principle of operation of the described scroll type refrigerant compressor is well known. Namely, the rotation of the drive shaft about the axis of rotation "Os" in the direction "M" is converted into the orbiting motion of the bushing member along an orbiting circle "rc" about the central axis "Os" with a radius "R" corresponding the distance between the two central axes "Os" and "Ob". The orbiting motion of the bushing member is transmitted to the movable scroll unit to cause the orbiting motion of the movable scroll unit in relation to the stationary scroll unit via the bearing element and the rotation preventing unit. As a result, a gradual shifting of lines of contact between the spiral member of the stationary scroll unit and that of the movable scroll unit from radially outer portions of both units toward radially central portions of both units occurs. Therefore, refrigerant pockets are successively formed between the stationary scroll unit and the movable scroll unit and shifted gradually toward the center of both units while the volume thereof is reduced. Consequently, the refrigerant gas introduced initially through a refrigerant inlet port of the compressor into the refrigerant pockets is gradually compressed and eventually discharged from the refrigerant pockets toward a discharge chamber of the compressor via an outlet port formed in the end plate member of the stationary scroll unit.

Namely, when the orthogonal coordinate system having a Y-axis and a X-axis, and a line "l" tangential to the circle "rc" at a point corresponding to the center axis "Ob" of the bushing member are taken as shown in FIG. 18, a drive force "F" exerted by the drive shaft acts on the drive key member in a direction perpendicular to the diametrical axis "S" of the drive key member so as to cause the rotation of the drive key member in the rotating direction "M" . Also, a centrifugal force "FC" acts in the direction along the Y-axis so as to cause a rotation of the drive bushing member about its own axis and the orbiting motion of the movable scroll unit. Thus, the drive bushing member is permitted to perform a limited amount of linear sliding in the direction along the diametrical axis "S" by utilizing the engagement thereof with the drive key member to thereby adjustably change the radius "R" of the circle of the orbiting motion of the movable scroll unit.

Namely, when the force "F" is divided into a first force component "Ft" parallel with the X-axis and a second force component "Fn" perpendicular to the tangential line "l", the first force component "Ft" is balanced with a reaction force of compression acting on the drive bushing member via the movable scroll unit in the direction along the tangential line "l".

Further, as shown in FIG. 18, even when the centrifugal force "Fc" is small, a combined force "Fp" of the centrifugal force "Fc" and the drive force "F" acts as a force directed in the positive direction of and angularly shifted from the Y-axis. Therefore, a force component "Fpn" of the combined force "Fp" along the Y-axis acts on the movable spiral member of the movable scroll unit so as to press it against the stationary spiral member of the stationary scroll unit. Accordingly, the air pockets, i.e., the compression chambers, can be airtightly sealed even when the drive shaft rotates at a low speed.

Moreover, the drive bushing member can slide in a direction so as to reduce the radius "R" of the orbiting motion thereof, i.e., in the direction corresponding to the negative direction of the Y-axis, and therefore it is possible to absorb or compensate for a minute misalignment in the engagement of the stationary and movable scroll units as well as to avoid a collision of both units which occurs when the direction of orbiting motion of the movable scroll unit is reversed at the moment of stopping of the compressor or when any foreign materials enter into the interior of the compressor.

Nevertheless, as shown in FIG. 19, in the afore-mentioned conventional scroll type compressor, the dive key member 90 of the drive shaft 91 and the drive bushing member (not shown in FIG. 19) are engaged in such a manner that the diametrical axis "S" of the drive key member 90 passes through the central axis "Ob" of the drive bushing member. Thus, it is impossible to determine the position of the central axis "Op" of the drive key member 90 only by directly measuring a distance between the central axis "Op" and the central axis "Os" of the drive shaft 91. Namely, the position of the central axis "Op" of the drive key member 90 must be determined by taking the position of the central axis "Ob" of the drive bushing member into consideration. As a result, at the stage of designing and manufacturing the drive shaft 91 having the drive key member 90, it is difficult to accurately determine the position of the drive key member 90 with regard to the central axis "Os" of the drive shaft 90. Due to the difficulty in accurately determining the position of the central axis "Op" of the drive key member 90, it is further difficult to accurately determine the diametrical axis "S" thereof which is angularly shifted by an angle "$\alpha$" from the Y-axis toward the direction reverse to the direction of rotation of the drive shaft. It is, accordingly, difficult to accurately form planar sliding faces 90*a* of the drive key member 90 integrally extending from the end of the drive shaft 91. The difficulty in accurate forming of the drive key member 90 integral with the drive shaft 91 eventually makes it imposible to mass-produce scroll type refrigerant compressors at low cost.

SUMMARY OF THE INVENTION

Therefore, an object of the present invention is to provide a scroll type refrigerant compressor which is internally improved so as to obviate problems encountered by the conventional scroll type refrigerant compressor.

Another object of the present invention is to provide a scroll type refrigerant compressor in which an airtight sealing of the compression chambers formed between the stationary and movable scroll units is constantly maintained without occurrence of a strong damaging engagement between both scroll units during the operation of the compressor.

A further object of the present invention is to provide a scroll type refrigerant compressor provided with an improved internal compressing mechanism which makes it possible to mass-produce the compressors at low manufacturing cost.

In accordance with the present invention, there is provided a scroll type refrigerant compressor adapted for use in, for example, a vehicle refrigerating system, which comprises:

an axial housing means forming an outer casing of the compressor and defining a refrigerant suction passage means, a discharge chamber and a compression organizing chamber receiving therein a compressing means, the housing means having an axis thereof extending axially at a substantially center portion thereof;

a stationary scroll means stationarily encased in the housing means and including a stationary spiral member and a stationary end plate member attached to an end of the spiral member;

a movable scroll means engaged with the stationary scroll means and moving along a predetermined orbiting path with respect to the stationary scroll means to thereby define compression chambers between both scroll means;

a drive shaft supported in the housing means via a bearing means so as to be rotated about an axis of rotation thereof, and having an axial shaft portion and a large diameter portion formed at an innermost portion of the axial shaft portion;

a drive key member projecting from an end of the large diameter portion of the drive shaft; and, a drive bushing member slidably engaged with the drive key member of the drive shaft and having a central axis thereof parallel with the axis of rotation of the drive shaft, the drive bushing member operatively engaged with the spiral member of the movable scroll means via a bearing means so as to drive the orbiting motion of the movable scroll means along the predetermined orbiting path in cooperation with means for preventing rotation of the movable scroll means about its own central axis during rotation of the drive shaft, and;

the stationary scroll means, the movable scroll means, the axial drive shaft, the drive key member, and the drive bushing member forming the compressing means successively compressing the refrigerant gas in the compression chambers;

wherein the drive key member is formed as an axial columnar mechanical member having a central axis thereof parallel with the axis of rotation of the drive shaft and a diametrical axis thereof intercrossing the central axis at a predetermined point, the diametrical axis of the drive key member being arranged so as to be angularly shifted by a predetermined angle in a direction reverse to the rotating direction of the drive shaft with regard to a predetermined axis passing the axis of rotation of the drive shaft, the predetermined point of the drive key member being arranged in an area extending in a direction reverse to the rotating direction of the drive shaft with regard to a line connecting the axis of rotation of the drive shaft and the central axis of the drive bushing member, the drive key member further having planar faces disposed on both sides of the diametrical axis thereof, and two spaced ends extending so as to interconnect between the planar faces, each of the two spaced ends being distant from the central axis of the drive shaft.

In accordance with the present invention, there is further provided a scroll type refrigerant compressor adapted for use in, for example, a vehicle refrigerating system, which comprises:

an axial housing means forming an outer casing of the compressor and defining a refrigerant suction passage means, a discharge chamber and a compression organizing chamber receiving therein a compressing means, the housing means having an axis thereof extending axially at a substantially center portion thereof;

a stationary scroll means stationarily encased in the housing means and including a stationary spiral member and a stationary end plate member attached to an end of the spiral member;

a movable scroll means engaged with the stationary scroll means and moving along a predetermined orbiting path with respect to the stationary scroll means to thereby define compression chambers between both scroll means;

a drive shaft supported in the housing means via a bearing means so as to be rotated about an axis of rotation thereof, and having an axial shaft portion and a large diameter portion formed at an innermost portion of the axial shaft portion;

a drive key member projecting from an end of the large diameter portion of the drive shaft; and, a drive bushing member slidably engaged with the drive key member of the drive shaft and having a central axis thereof parallel with the axis of rotation of the drive shaft, the drive bushing member operatively engaged with the spiral member of the movable scroll means via a bearing means so as to drive an orbiting motion of the movable scroll means in cooperation with means for preventing rotation of the movable scroll means about its own central axis during rotation of the drive shaft, and;

the stationary scroll means, the movable scroll means, the axial drive shaft, the drive key member, and the drive bushing member forming the compressing means successively compressing the refrigerant gas in the compression chambers;

wherein the drive key member is formed as an axial columnar mechanical member having a central axis thereof parallel with the axis of rotation of the drive shaft and a diametrical axis thereof intercrossing the central axis at a predetermined point, the diametrical axis of the drive key member being angularly shifted by a predetermined angle in a direction reverse to the rotating direction of the drive shaft with regard to a predetermined axis passing the central axis of the drive shaft, the predetermined point of the drive key member being arranged at a point where the diametrical axis and a line tangential with a predetermined circle having a radius corresponding to a distance between the central axis of the drive shaft and the central axis of the drive bushing member and intercrossing the central axis of the drive bushing member, the drive key member being provided with planar faces arranged on both sides of the diametrical axis thereof.

BRIEF DESCRIPTION OF THE DRAWINGS

The above and other objects, features and advantages of the present invention will be made more apparent from the ensuing description of preferred embodiments thereof in conjunction with the accompanying drawings wherein:

FIG. 18 is a schematic front view illustrating an important portion for driving the operation of the stationary and movable scroll units according to a prior art; and FIG. 19 is a schematic front view of an inner end of a drive shaft provided with a drive key member according to the same prior art.

DESCRIPTION OF THE PREFERRED EMBODIMENTS

Figure 1:
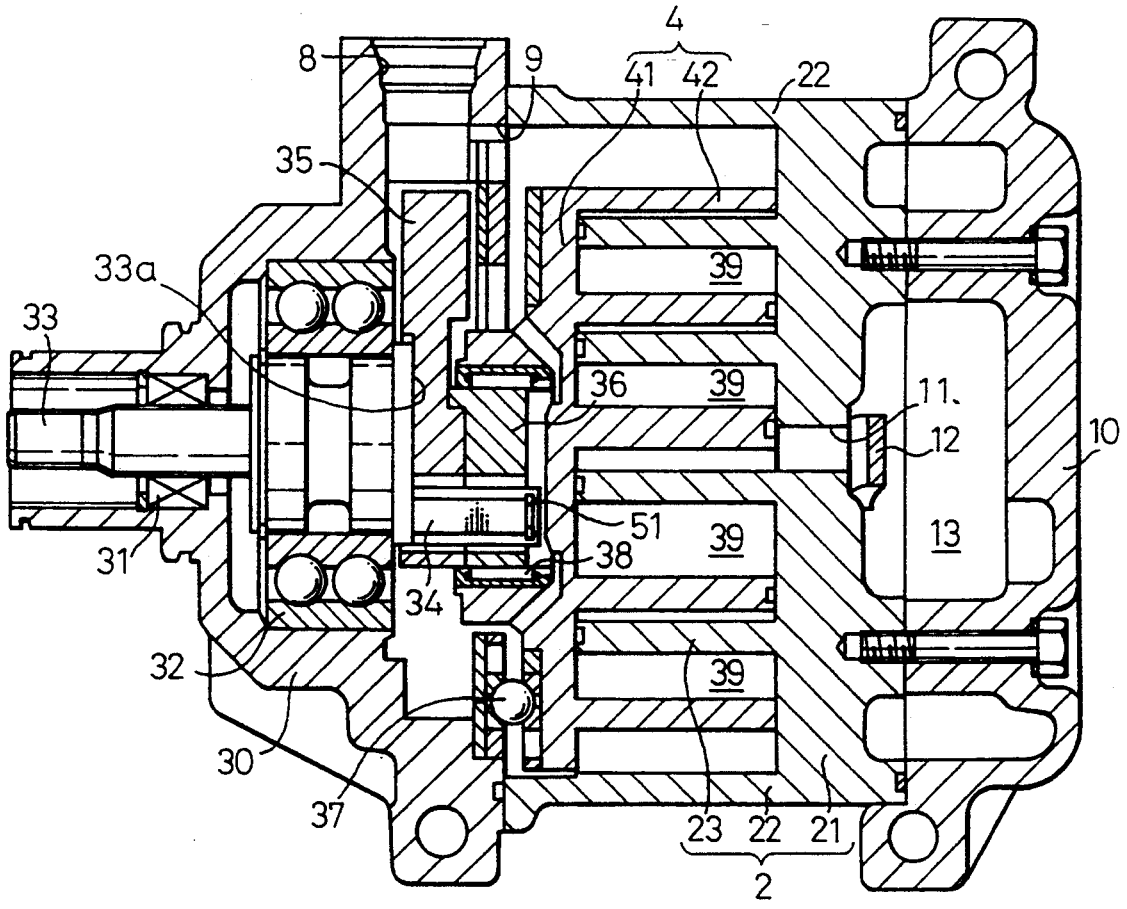
FIG. 1 is a longitudinal cross-sectional view of a scroll type refrigerant compressor in which an improvement according to the present invention is applied.

It should be understood that throughout the drawings, the same and like elements and parts are designated by the same reference numerals.

Referring to FIG. 1, the scroll type refrigerant compressor to which an improvement according to the present invention is applied is provided with a housing unit including a front housing member 30, a rear housing member 10 and a middle housing portion arranged between the front and rear housing members 30 and 10. The scroll type compressor is also provided with a stationary end plate 21 fixedly attached to an inner face of the rear housing 10, and a shell member 22 formed so as to be integral with the stationary end plate 21 and forming the middle housing of the compressor. The compressor is further provided with a stationary spiral member 23 in the form of a spirally extending wall member integral with the stationary end plate 21. The stationary spiral member 23 may extend along, e.g., an involute curve with respect to a given central axis in parallel with a longitudinal axis of the housing of the compressor. The stationary end plate 21, the shell member 22, and the stationary spiral member 23 forms a stationary scroll unit 2 of the compressor.

The compressor is further provided with a movable scroll unit 4 including a movable end plate 41 disposed to be axially opposed to the stationary end plate 21, and a movable spiral member 42 formed as a wall member extending along, e.g., an involute curve about a given axis thereof. The movable spiral member 42 is attached to an inner face of the movable end plate 41. The movable scroll unit 4 is engaged with the stationary scroll unit 2 so as to define refrigerant pockets functioning as compression chambers 39.

The front housing 30 fixedly combined with the shell member 22 of the stationary scroll unit 2 has a central bore in which an axial drive shaft 33 is supported by means of a shaft seal member 31 and a rotary bearing 32. The drive shaft 33 has an axis of rotation thereof designated by "Os" in, for example, FIGS. 2 and 11, and a large diameter portion formed at an inner portion thereof which is fitted in the inner bore of the rotary bearing 32. The large diameter portion of the drive shaft 33 has an inner end face **33*a* from which a drive key or slide key member 34 axially projects toward an interior of the compressor. The drive key member 34 is formed as a part-cylindrical or columnar projection having a later-described central axis "Op" and diametrical axis "S". The drive key member 34 is engaged with a counterweight member 35 arranged adjacent to the inner end face 33*a* of the large diameter portion of the drive shaft 33 and with a drive bushing member 36**.

An improved internal compression mechanism applied to the described scroll type refrigerant compressor in accordance with the present invention will be described below, with reference to the preferred embodiments.

Figure 2:
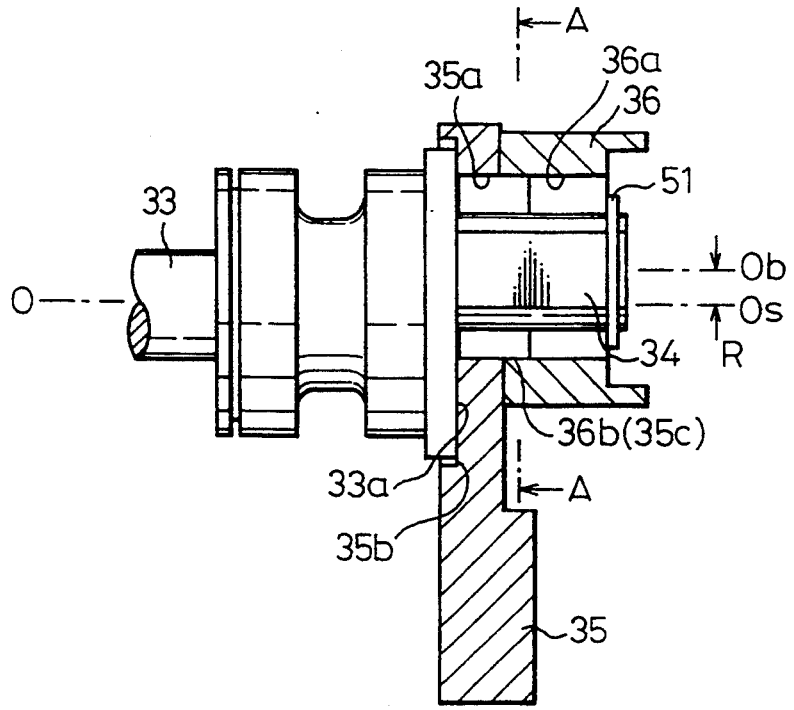
FIG. 2 is a partial side view, in partial cross section in the direction B—B of FIG. 6, of an important portion, i.e., an inner end portion of a drive shaft provided with a drive key member according to a first embodiment of the present invention and engaged with a drive bushing member when the shaft is accommodated in the scroll type refrigerant compressor of FIG. 1.
Figure 3:
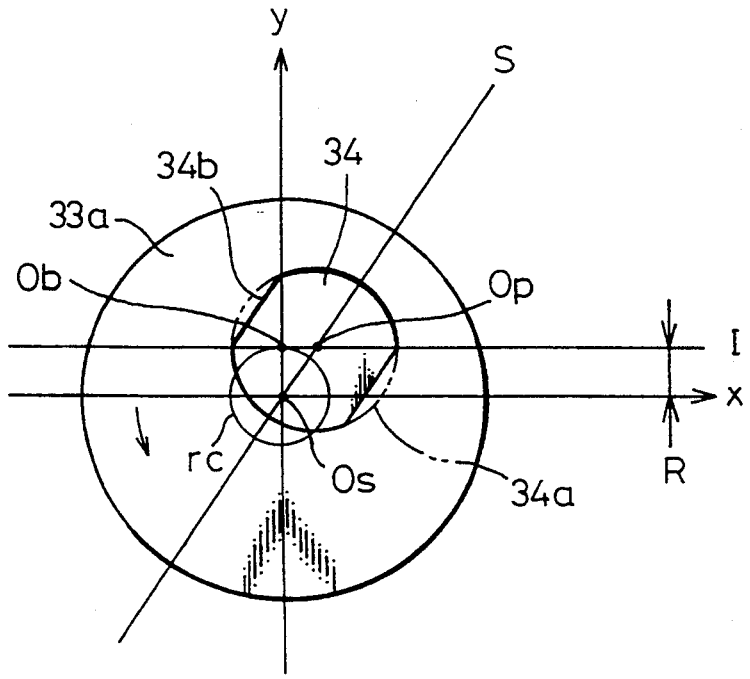
FIG. 3 is a schematic front view of the important portion of the compressor of FIG. 1, illustrating the positional relationship between the end of the drive shaft and the drive key member.

Referring first to FIGS. 2 and 3, a drive shaft 33 is illustrated, which is provided with a drive key member 34 according to the first embodiment of the present invention. The drive key member 34 is formed so as to axially project from an inner end face **33*a* of the drive shaft 33, and is engaged with a counterweight 35 and a drive bushing member 36. The method of forming the drive key member 34** is briefly described below.

A large diameter portion of the drive shaft 33 having the above-mentioned inner end face **33*a* is initially formed as a generally circular element around the axis of rotation "Os" of the drive shaft 33. Further, when the drive key member 34 is formed at the inner end face 33*a* of the large diameter portion of the drive shaft 33, the positional relationship between the large diameter portion of the drive shaft 33 and the drive key member 34 is determined as best shown in FIG. 3. Namely, an orbiting circle "rc" having a predetermined radius "R" corresponding to a distance between the axis of rotation "Os" of the drive shaft 33 and the central axis "Ob" of the drive bushing member 36 is defined. Subsequently, a line "l" is drawn so as to be tangential with the orbiting circle "rc" at a point corresponding to the central axis "Ob" of the drive bushing member 36. Further, an orthogonal coordinating system having an Y-axis extending in a direction in which the drive key member 34 is to be eccentrically shifted with regard to the axis of rotation of the drive shaft 33, and an X-axis orthogonal to the Y-axis is assumed. Thereafter, a diametrical axis "S" of the drive key member 34 is determined so that it extends from the axis of rotation "Os" of the drive shaft 33 in a direction angularly shifted by a predetermined angle "$\alpha$" from the Y-axis. Then, an intercrossing point of the two lines "S" and "l" is determined. As a result, an axis passing through the determined intercrossing point is determined as a central axis "Op" of the drive key member 34. That is, the position of the central axis "Op" of the drive key member 34 can be determined by directly setting and measuring a distance between the central axis "Os" of the drive shaft 33** and the intercrossing point of the two lines "l" and "S".

Therefore, when the position of the central axis "Op" of the drive key member 34 is determined, it is easily possible to form a cylindrical projection **34*a* extending from the inner end face 33*a* of the large diameter portion of the drive shaft 33 around the determined central axis "Op". The forming of the cylindrical projection 34*a* can be achieved by, for example, a precision forging method. Subsequently, a pair of planar faces 34*b* are symmetrically formed in the outer circumference of the cylindrical projection 34*a* on both sides of the diametrical axis "S". Namely, the planar sliding faces 34*b* of the drive key member 34 are formed. As a result, the formation of the drive key member 34 in the inner end face 33 a of the drive shaft 33 is completed. Thus, the simplicity of the formation of the drive key member 34** can greatly contribute to the mass production of the scroll type refrigerant compressor at low cost.

Figure 4:
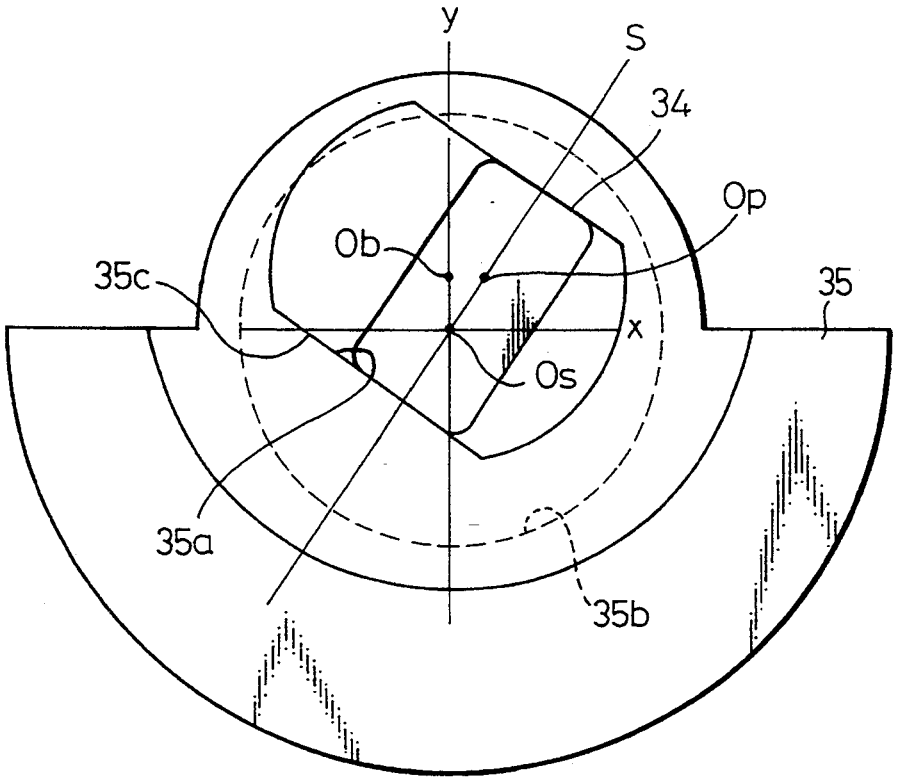
FIG. 4 is a front view of a counterweight accommodated in the compressor of FIG. 1.

As shown in FIG. 4, the counterweight 35 is provided with an aperture **35*a* in the form of a through-hole elongated in the direction of the line "S" and permitting the drive key member 34 to slide therein when it is engaged therein. The counterweight 35 is also provided with a partially-circular counter groove 35*b* in the face opposing the inner end face 33 a of the large diameter portion of the drive shaft 33. The counter groove 35*b* is provided for loosely receiving the inner end face 33*a* of the large diameter portion of the shaft 33 as best shown in FIG. 2**.

Figure 6:
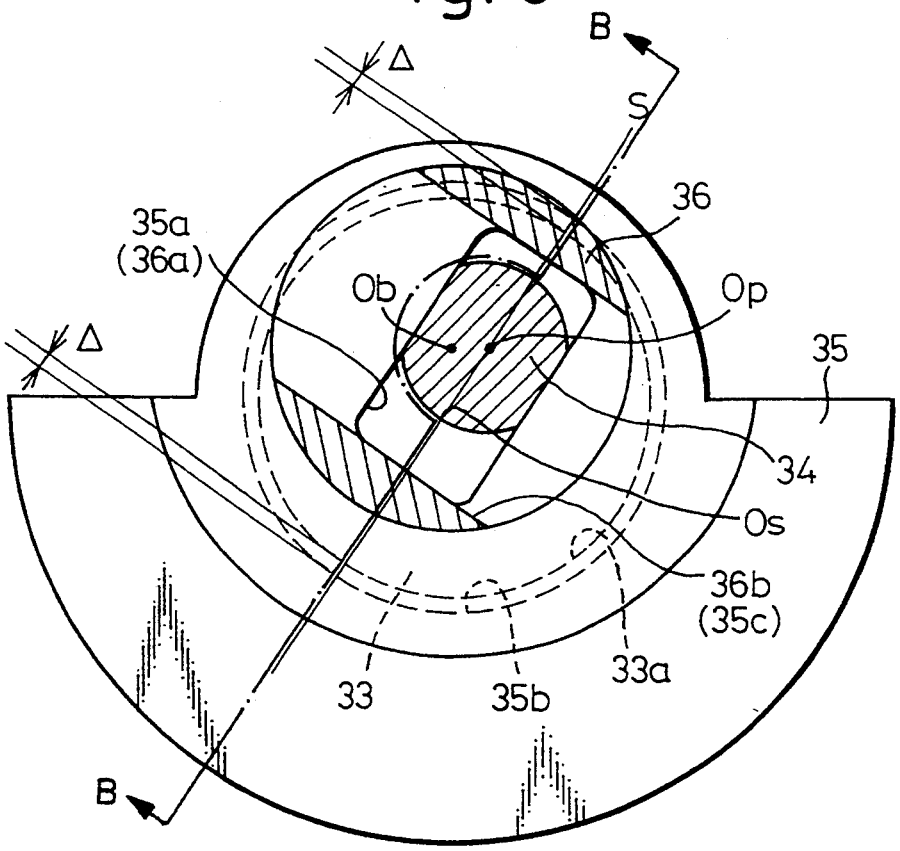
FIG. 6 is a cross-sectional view taken along the line A—A of FIG. 2.

Referring to FIG. 6, the drive key member 34 is engaged in the aperture **35*a* of the counter weight 35 in such a manner that the counterweight 35 can slide radially with respect to the central axis "Op" of the drive key member 34. Nevertheless, the counter groove 35*b* of the counterweight 35 is formed in such a manner that a predetermined small amount of gap ±"Δ" is provided between the wall of the counter groove 35*b* of the counter weight 35 and the outer circumference of the large diameter portion of the drive shaft 33 in the direction of line "S". The amount of the gap ±"Δ" is considerably smaller than that of a gap left between the drive key member 34 and the wall of the aperture 35*a* of the counterweight 35. Thus, the radial sliding of the counterweight 35 with respect to the drive key member 34 of the drive shaft 33 is restricted by the above-mentioned small gap ±"Δ" left between the counterweight 35 and the large diameter portion of the drive shaft 33**.

The counterweight 35 is also provided with a land portion **35*c* having an end perpendicular to the diametrical line "S" of the drive key member 34 as shown in FIG. 4**.

Figure 5:
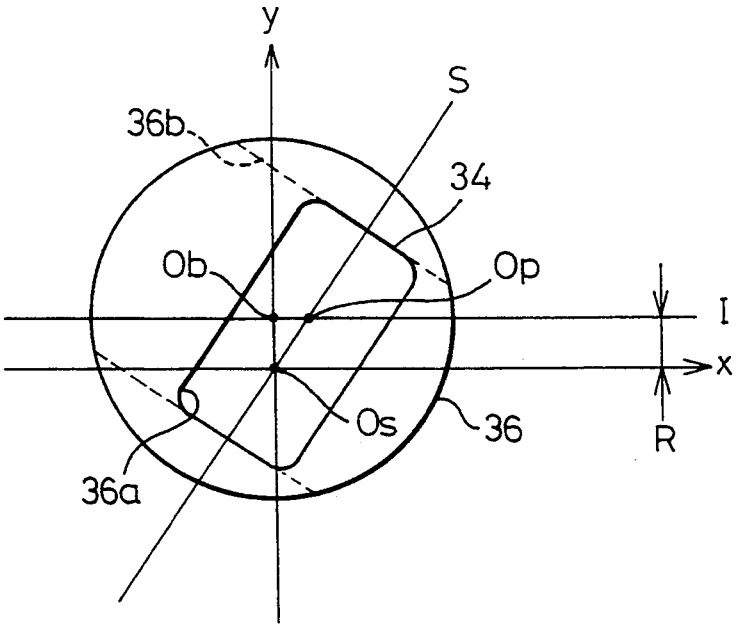
FIG. 5 is a schematic front view of the drive bushing member accommodated in the compressor of FIG. 1.

Referring to FIG. 5, the drive bushing member 36 engaged with the above-mentioned drive key member 34 is formed as a cylindrical mechanical element having a central axis "Ob". The drive bushing member 36 is operatively engaged with and supports the movable scroll unit 4 (FIG. 1) via the rotation preventing means 37 and the rotary bearing 38. Thus, the drive bushing member 36 permits the movable scroll unit 4 to perform only an orbiting motion with regard to the stationary scroll unit 2. The drive bushing member 36 is provided with an aperture 36*a* formed therein as a through-hole similar to the afore-mentioned aperture 35*a* of the counterweight 35. As shown in FIG. 2, the drive bushing member 36 is fitted on and engaged with the drive key member 34 of the drive shaft 33 in such a manner that the drive bushing member 34 of the drive shaft 33 is inserted in the aperture 36*a* of the drive bushing member 36. The drive bushing member 36 is further provided with a recessed portion 36*b* formed in the end face thereof confronting the end face of the counterweight 35. The recessed portion 36*b* of the drive bushing member 36 is provided with a pair of shoulders extending perpendicularly to the diametrical axis "S" of the drive key member 34 and, the recessed portion 36*b* of the drive bushing member 36 is engaged with the land portion 35*c* of the counterweight 35 as shown in FIG. 2, and accordingly, the drive bushing member 36 can slide in the direction corresponding to the diametrical axis "S" of the drive key member 34 together with the counter weight 35 to thereby adjustably change the radius of the orbiting motion of the movable scroll unit 4 (FIG. 1). The sliding motion of the drive bushing member 36 is accordingly restricted when the wall of the counter groove 35*b* of the counterweight 35 is abutted against the outer circumference of the large diameter portion of the drive shaft 33.

As shown in FIG. 2, an inner end of the drive key member 34 of the drive shaft 33 is provided with a circular groove in which a cir-clip 51 is fitted so as to prevent withdrawal of the drive key member 34 from the apertures 35*a* and 36*a* of the counterweight 35 and the drive bushing member 36.

As best shown in FIG. 1, the front housing 30 is provided with an inlet port 8 which is communicated with an outer refrigerating circuit. The position of the inlet port 8 is in radial registration with the outer circumference of the counterweight 35, and is fluidly communicated with a refrigerant suction passageway 9 extending so as to pierce the front housing 30 and a part of the above-mentioned rotation preventing means 37. The refrigerant suction passageway 9 is routed so as to pass by the outer circumference of the counterweight 35, and is in direct fluid communication with the compression chambers 39 of the movable scroll unit 4.

The stationary end plate 21 of the stationary scroll unit 2 is provided with a discharge port 11 formed at a center thereof so as to be communicated with the compression chamber 39 at the final stage of compression of the refrigerant gas. The discharge port 11 is also communicated with a discharge chamber 13 formed inside the rear housing 10 via a discharge valve 12 in the form of a check valve. The discharge chamber 13 of the rear housing 10 can communicate with an outer refrigerating circuit via a non-illustrated outlet port. Namely, the compressed refrigerant gas is discharged from the discharge chamber 13 through the outlet port toward the outer refrigerating circuit.

The scroll type refrigerant compressor of FIG. 1 is adapted for use in a vehicle refrigerating system, and therefore, when the drive shaft 33 is connected to a vehicle engine via, e.g., a non-illustrated solenoid clutch. When the drive shaft 33 is rotated, the drive key member 34 is also rotated about the central axis "Os". Therefore, the drive bushing member 36 together with the counterweight 35 is rotated about the same central axis "Os" along an orbiting circle having a predetermined radius "R", and accordingly, as the movable scroll unit 4 is prevented by the rotation preventing means 37 from being rotated about its own central axis, the unit 4 is moved along an orbiting path about the central axis "Os" of the drive shaft 33 at the same radius "R". The orbiting motion of the movable scroll unit 4 causes gradual shifting of the compression chambers 39 formed by the stationary end plate and spiral members 21 and 23 of the stationary scroll unit 2, and the movable end plate and spiral members 41 and 42 of the movable scroll unit 4 from the radially outer portion of both scroll units 2 and 4 toward the center of both scroll units 2 and 4. During the shifting of each of the compression chambers 39, the volume thereof is gradually reduced. Thus, the refrigerant gas sucked from the inlet port 8 and the suction passageway 9 into the compression chambers 39 is gradually compressed therein. When each of the compression chambers 39 is shifted to the central portion of both scroll units 2 and 4, the compressed refrigerant gas is discharged from the compression chambers 39 toward the discharge chamber 13 via the outlet port 11 and the discharge valve 12.

Figure 7:
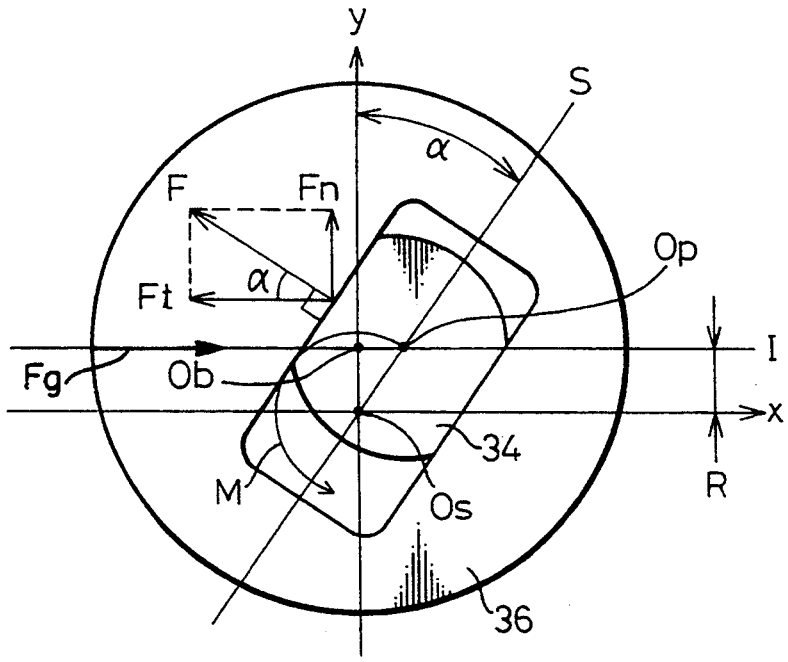
FIG. 7 is a diagrammatic view of the engaged drive key and bushing members, illustrating one of the positional relationships between both members.

At this stage, it will be understood from FIG. 7 that when the scroll type refrigerant compressor is operated by the rotation of the drive shaft 33 in a direction designated by "M", a force "F" is exerted by the drive shaft 33 via the drive key member 34 which acts in a direction perpendicular to the diametrical axis "S" of the drive key member 34 on the rotating side of the drive shaft 33. The counterweight 35 acts so as to absorb dynamic unbalance of the movable scroll unit 4 to thereby prevent the unit 4 from vibrating. Namely, the counterweight 35 compensates for a moment of eccentricity which is given by the movable scroll unit 4 to the drive bushing member 36. Therefore, no centrifugal force acts on the drive key member 34 of the drive shaft 33. Thus, the drive bushing member 36 and the counterweight 35 perform only a limited amount of sliding movement along the diametrical axis "S" of the drive key member 34 by the guide of the planar faces 34*b* of the member 34. Namely, when the above-mentioned drive force "F" is divided into two component forces, i.e., a force component "Ft" parallel to the X-axis (the tangential line "l"), and a force component "Fn" normal to the tangential line "l", the force component "Ft" ($=F\times\cos\alpha$) acts so as to counterbalance a reacting force of compression of the refrigerant gas which is applied to the drive bushing member 36 by the movable scroll unit 4.

Figure 8:
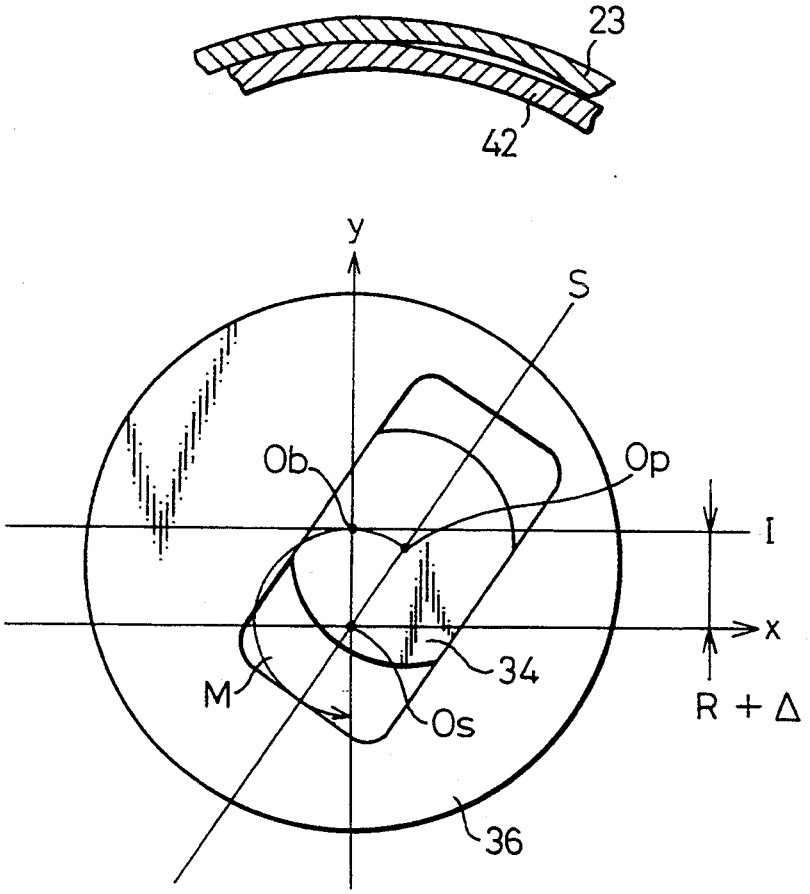
FIG. 8 is a diagrammatic view of the drive key member and the drive bushing member similar to that of FIG. 7, illustrating the other positional relationship between both members wherein an amount of eccentricity of the movable scroll unit is increased in comparison with the position of FIG. 7.

It should be understood that although the counterweight 35 may counterbalance the centrifugal force acting on the movable scroll unit 4, the drive force "F" is applied by the drive shaft 33 to the drive bushing member 36 via the drive key member 34 at a point distant from the central axis "Ob" in a direction angularly shifted from the X-axis and Y-axis of the orthogonal coordinate system, irrespective of the rotating speed of the drive shaft 33. Namely, the drive force "F" has the force component "Fn" as clearly shown in FIG. 7. The force component "Fn" of the drive force "F" urges the drive bushing member 36 to slide in a direction increasing the eccentricity of the drive bushing member 36 from an initial predetermined amount "R" to an increased value "R+Δ" as shown in FIG. 8. Accordingly, the radius of the orbiting motion of the drive bushing member 36 together with the movable spiral member 42 of the movable scroll unit 4 is increased. To this end, the movable spiral member 42 is radially urged toward the stationary spiral member 23 of the stationary scroll unit 2 to thereby ensure airtight sealing of the compression chambers 39 in the radial direction. During the compression of the refrigerant gas, a reaction force "Fg" acts on the movable scroll unit 4, and the force "Fg" is transmitted to the drive bushing member 36. The force "Fg" produces a force component "Fgs" ($=Fg\times\sin\alpha$) acting along the diametrical axis "S" of the drive key member 34. The force component "Fgs" will cause the sliding movement of the drive bushing member 36 and the counterweight 35 in the direction of the diametrical axis "S" by an amount "R+Δ". Namely, the amount of eccentricity of the drive bushing member 36 and the counterweight 35 is adjusted to the value "R+Δ". Since the force component "Fgs" has a Y-axis component corresponding to "Fgy" $(Fn)=Fg\times\sin\alpha\times\cos\alpha$, the Y-axis component "Fgy" of the force component "Fgs" urges the movable spiral member 42 of the movable scroll unit 4 toward the stationary spiral member 23 of the stationary scroll unit 2 (see FIG. 8) to thereby adequately seal the compression chambers 39.

Figure 9:
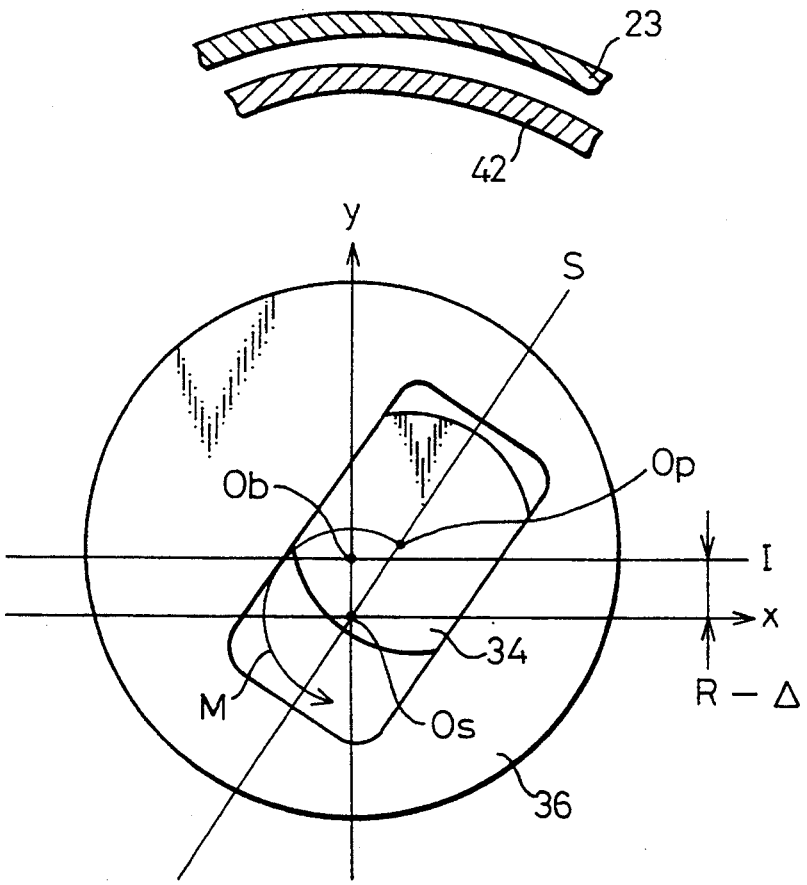
FIG. 9 is a diagrammatic view of the drive key member and the drive bushing member similar to that of FIG. 7, illustrating a further positional relationship between both members wherein an amount of eccentricity of the movable scroll unit is reduced in comparison with the position of FIG. 7.

Further, the drive bushing member 36 is allowed to slidably move in a direction reducing the amount of the eccentricity thereof from the initially determined amount "R" to a reduced amount "R−Δ" against the above-mentioned force component "Fn" as shown in FIG. 9. Therefore, the drive bushing member 36 can absorb a minute discrepancy in the engagement of the stationary and movable scroll units 2 and 4. Moreover, the strong damaging engagement of the stationary and movable spiral members 23 and 42 of the stationary and movable scroll units 2 and 4 due to a sudden reversal in the direction of rotation which may be caused by a stopping of the compressor or intrusion of foreign matter into the interior of the compressor can be avoided by the sliding of the drive bushing member 36 in a direction reducing the eccentricity thereof with regard to the axis of rotation of the drive shaft 33, as schematically shown in FIG. 9. Thus, the scroll type compressor in which the drive shaft 33 having the columnar-like drive key member 34 according to the above-described first embodiment may operate in such a manner that the airtight sealing of the compression chambers 39 defined between the stationary scroll unit 2 and the movable scroll unit 4 is constantly maintained irrespective of the rotating speed of the drive shaft 33, and accordingly a high compression efficiency of the compressor can be ensured. Further, the operating life of the mutually engaged stationary and movable spiral members 23 and 42 of the stationary and movable scroll units 2 and 4 can be ensured. In addition, since the drive key member 34 of the drive shaft 33 can be easily designed and manufactured in comparison with the drive key member of the prior art, reduction of the manufacturing cost of the scroll type refrigerant compressor per se may be achieved according to the first embodiment of the present invention.

A further improvement in the construction of the drive key member 34 of the drive shaft 33 over that of the first embodiment is provided below in conjunction with the second embodiment illustrated in FIGS. 10 through 15.

It should be understood that the improved compression drive means according to the second embodiment may be accommodated in a scroll type refrigerant compressor in the same manner as that of the first embodiment. Thus, the scroll type refrigerant compressor of FIG. 1 may generally be considered a compressor in which the compression drive means of the second embodiment can be incorporated.

Figure 10:
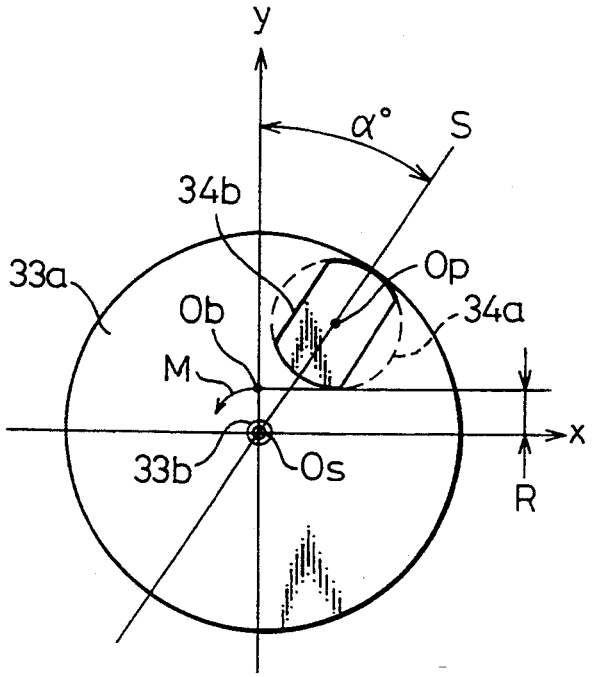
FIG. 10 is a schematic front view of a drive shaft provided with a drive key member according to a second embodiment of the present invention and adapted for being accommodated in a scroll type refrigerant compressor.
Figure 11:
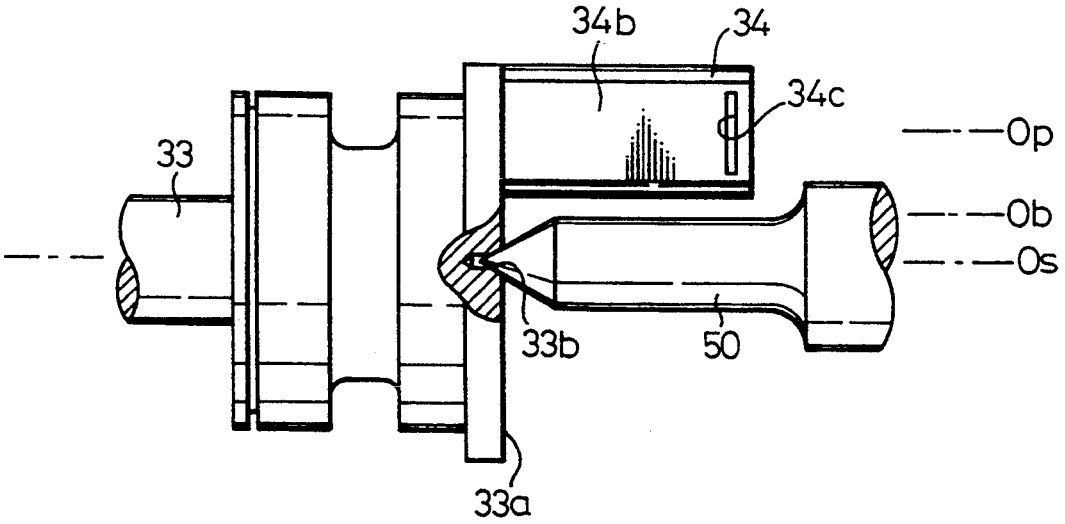
FIG. 11 is a partial side view, in partial cross section, of an important portion, i.e., an inner end portion of a drive shaft provided with a drive key member according to the second embodiment of the present invention.

Referring now to FIGS. 10 and 11, a drive shaft 33 having an axis of rotation "Os" is rotatably supported in the scroll type refrigerant compressor of FIG. 1. The drive shaft 33 is provided with a large diameter portion having an inner end face from which a drive key member 34 having a later-described central axis "Op" and two planar faces **34*b* axially projects as an integral columnar part of the drive shaft 33. A central axis designated by "Ob" in FIG. 10 is a central axis of a drive bushing member described later in conjunction with FIG. 13**.

Figure 13:
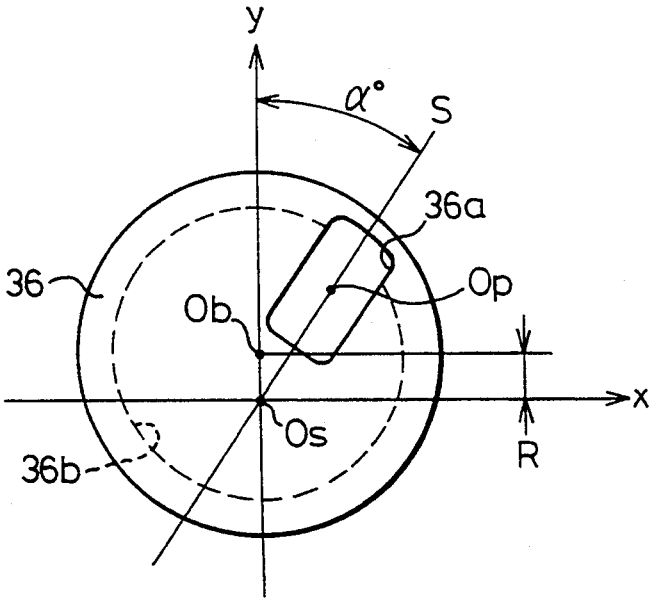
FIG. 13 is a schematic front view of a drive bushing member cooperating with the drive key member of the second embodiment.

As shown in FIG. 10, when the drive key member 34 is formed in an end face of the large diameter portion of the drive shaft 33, and orbiting radius "R" of the movable scroll unit 4 is determined so that the length of the radius "R" corresponds to a distance between the axis of rotation "Os" of the drive shaft 33 and the central axis "Ob" of the drive bushing member 36 (FIG. 13).

Further, an orthogonal coordinating system having a Y-axis extending in a direction in which the central axis of the drive bushing member 36 is eccentrically shifted with regard to the axis of rotation of the drive shaft 33, and a X-axis perpendicular to the Y-axis is determined on the end face of the drive shaft 33.

Moreover, a diametrical axis "S" of the drive key member 34 radially drawn from the axis "S" is angularly shifted from the Y-axis by an angle "α" in a direction reverse to the rotating direction of the drive shaft 33. Subsequently, the position of a given point "Op" is determined on the axis "S" so as to establish a preselected distance between the axis of rotation "Os" and the point "Op". The point "Op" lies in an area of the inner end face belonging to the trailing side of the Y-axis with respect to the rotating direction "M" of the drive shaft 33. Namely, the point "Op" lies in the area in the first quadrant of the orthogonal X- and Y-axis coordinating system of FIG. 2. Then, an axis passing through the point "Op" is determined as a central axis "Op" of the drive key member 34. It should be understood that the position of the point "Op" can be set by directly measuring the preselected distance with regard to the axis of rotation "Os" of the drive shaft 33.

The drive key member 34 is initially formed as a substantially cylindrical columnar projection **34*a* shown by a dotted line in FIG. 10, and having a central axis "Op" thereof parallel with the axis of rotation "Os" of the drive shaft 33 by a precision forging method. The position of the central axis "Op" is selected so that the outer circumference of the columnar projection 34*a* is spaced away from the axis of rotation "Os" of the drive shaft 33, and the distance between both central axes "Op" and "Os" is determined by the above-described direct measurement by an appropriate measuring device. Thus, as shown in FIG. 11, a center hole 33*b* can be formed in the inner end face 33*a* of the large diameter portion of the drive shaft 33. Accordingly, a centering tool 50 such as a live center and/or a dead center of a machine tool such as a lathe can be easily set in the center hole 33***b* so as to perform a finishing-cutting of the drive shaft 33.

Subsequently, a pair of parallel planar faces 34*b* arranged symmetrically with respect to the diametrical axis "S" are cut by, e.g., a milling machine on the outer circumference of the columnar projection 34*a*. Finally, a through-hole 34*c* running perpendicularly to the central axis "Op" of the drive key 34 is bored in an inner end portion of the columnar projection 34*a*, and the forming of the drive key member 34 is completed.

From the foregoing description of the second embodiment, it will be understood that the forming of the drive key member 34 in the end face 33*a* of the large diameter portion of the drive shaft 33 may be easily achieved, and accordingly, the drive shaft 33 having the drive key member 34 can be manufactured at a low manufacturing cost to thereby enable mass production of many drive shafts 33 with a high degree of accuracy. The size of the drive key member 34 of the drive shaft 33 may be selected so as to comply with the entire size and capacity of the scroll type refrigerant compressor. Further, the drive key member 34 of the drive shaft 33 according to the second embodiment is formed without reducing the size thereof compared with, for example, the conventional drive key member as shown in FIGS. 18 and 19, and may be accommodated in the compressor without requiring a change in the size of the large diameter portion of the drive shaft 33 and the size of the drive bushing member 36. Thus, the drive key member 34 may be provided with an appropriate mechanical strength and rigidity. Naturally, the drive key member 34 of the second embodiment does not bring about an increase in the size of the compressor.

Figure 12:
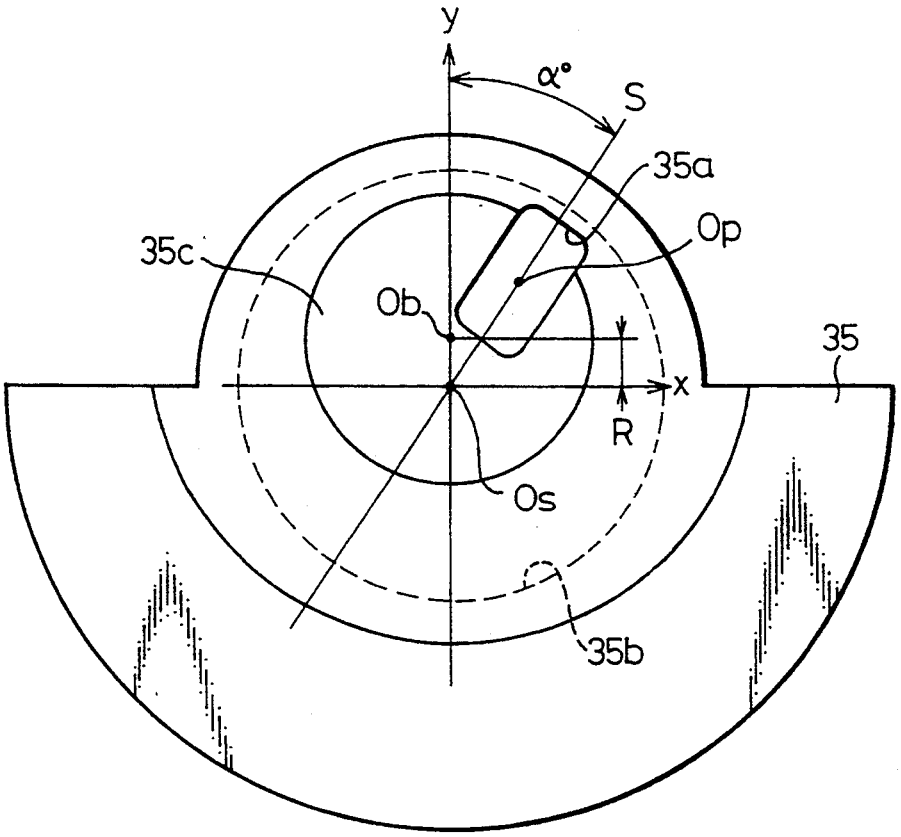
FIG. 12 is a front view of a counterweight used with the drive shaft when it is accommodated in the scroll type refrigerant compressor as shown in FIG. 1.

As shown in FIG. 12, the counterweight 35 is provided with an aperture 35*a* in the form of a rectangular through-hole elongated in the direction of the line "S" and permitting the drive key member 34 to slide therein when it is engaged therein. The counterweight 35 is also provided with a partially-circular counter groove 35*b* in the face opposing the inner end face 33*a* of the large diameter portion of the drive shaft 33. The counter groove 35*b* is provided for loosely receiving the inner end face 33*a* of the large diameter portion of the shaft 33 as best shown in FIG. 14.

Figure 14:
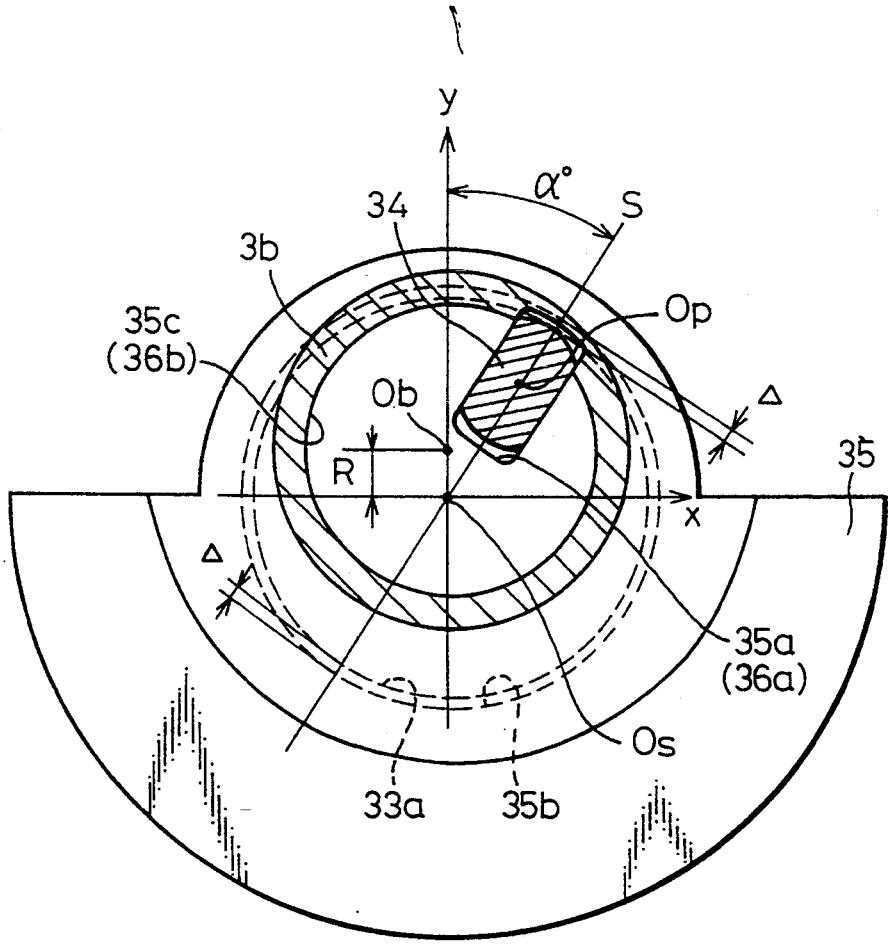
FIG. 14 is a schematic front view, in partial cross section, of the assembly of the drive shaft, the counterweight, and the drive bushing member of FIGS. 10 through 13.

Referring to FIG. 14, the drive key member 34 is engaged in the aperture 35*a* of the counterweight 35 in such a manner that the counterweight 35 can slide radially with respect to the central axis "Op" of the drive key member 34. Nevertheless, the counter groove 35*b* of the counterweight 35 is formed in such a manner that a predetermined small amount of gap ±"Δ" is provided between the wall of the counter groove 35*b* of the counterweight 35 and the outer circumference of the large diameter portion of the drive shaft 33 in the direction of line "S". The amount of the gap ±"Δ" is considerably smaller than that of a gap left between the drive key member 34 and the wall of the aperture 35*a* of the counterweight 35. Thus, the radial sliding of the counter weight 35 with respect to the drive key member 34 of the drive shaft 33 is restricted by the above-mentioned small gap ±"Δ" left between the counterweight 35 and the large diameter portion of the drive shaft 33.

The counterweight 35 is also provided with a cylindrical land portion 35*c* formed to be coaxial with the central axis "Ob" of the drive bushing member 36 in the end face thereof confronting the drive bushing member 36 as shown in FIG. 12. The afore-mentioned aperture 35*a* is formed so as to pierce a part of the cylindrical land portion 35*c*.

Referring to FIG. 13, the drive bushing member 36 engaged with the above-mentioned drive key member 34 is formed as a cylindrical mechanical element having a central axis "Ob". The drive bushing member 36 is operatively engaged with and supports the movable scroll unit 4 (FIG. 1) via the rotation preventing means 37 and the rotary bearing 38. Thus, the drive bushing member 36 permits the movable scroll unit 4 to perform only an orbiting motion with regard to the stationary scroll unit 2. The drive bushing member 36 is provided with an aperture 36*a* formed therein as a through-hole similar to the afore-mentioned aperture 35*a* of the counterweight 35. The drive bushing member 36 is fitted on and engaged with the drive key member 34 of the drive shaft 33 in such a manner that the drive bushing member 34 of the drive shaft 33 is inserted in the aperture 36*a* of the drive bushing member 36. The drive bushing member 36 is further provided with a circular recessed portion 36*b* formed in the end face thereof confronting the end face of the counterweight 35. The cylindrical recessed portion 36*b* of the drive bushing member 36 is engaged with the cylindrical land portion 35*c* of the counterweight 35 as shown in FIG. 14, and accordingly, the drive bushing member 36 can slide in the direction corresponding to the diametrical axis "S" of the drive key member 34 together with the counterweight 35 to thereby adjustably change the radius of the orbiting motion of the movable scroll unit 4 (FIG. 1). The sliding motion of the drive bushing member 36 is accordingly restricted when the wall of the counter groove 35*b* of the counterweight 35 is abutted against the outer circumference of the large diameter portion of the drive shaft 33.

As shown in FIG. 2, an inner end of the drive key member 34 of the drive shaft 33 is provided with a circular groove in which a cir-clip 51 is fitted so as to prevent withdrawal of the drive key member 34 from the apertures 35*a* and 36*a* of the counterweight 35 and the drive bushing member 36.

As best shown in FIG. 1, the front housing 30 is provided with an inlet port 8 which is communicated with an outer refrigerating circuit. The position of the inlet port 8 is in radial registration with the outer circumference of the counterweight 35, and is fluidly communicated with a refrigerant suction passageway 9 extending so as to pierce the front housing 30 and a part of the above-mentioned rotation preventing means 37. The refrigerant suction passageway 9 is routed so as to pass by the outer circumference of the counterweight 35, and is in direct fluid communication with the compression chambers 39 of the movable scroll unit 4.

The stationary end plate 21 of the stationary scroll unit 2 is provided with a discharge port 11 formed at a center thereof so as to communicate with the compression chamber 39 at the final stage of compression of the refrigerant gas. The discharge port 11 also communicates with a discharge chamber 13 formed inside the rear housing 10 via a discharge valve 12 in the form of a check valve. The discharge chamber 13 of the rear housing 10 can communicate with an outer refrigerating circuit via a non-illustrated outlet port. Namely, the compressed refrigerant gas is discharged from the discharge chamber 13 through the outlet port toward the outer refrigerating circuit.

The scroll type refrigerant compressor of FIG. 1 is adapted for use in a vehicle refrigerating system, and therefore, when the drive shaft 33 is connected to a vehicle engine via, e.g., a non-illustrated solenoid clutch. When the drive shaft 33 is rotated, the drive key member 34 is also rotated about the central axis "Os". Therefore, the drive bushing member 36 together with the counterweight 35 is rotated about the same central axis "Os" along an orbiting circle having a predetermined radius "R", and accordingly, as the movable scroll unit 4 is prevented by the rotation preventing means 37 from being rotated about its own central axis, the unit 4 is moved along an orbiting path about the central axis "Os" of the drive shaft 33 at the same radius "R". The orbiting motion of the movable scroll unit 4 causes gradual shifting of the compression chambers 39 formed by the stationary end plate and spiral members 21 and 23 of the stationary scroll unit 2, and the movable end plate and spiral members 41 and 42 of the movable scroll unit 4 from the radially outer portion of both scroll units 2 and 4 toward the center of both scroll units 2 and 4. During the shifting of each of the compression chambers 39, the volume thereof is gradually reduced. Thus, the refrigerant gas sucked from the inlet port 8 and the suction passageway 9 into the compression chambers 39 is gradually compressed therein. When each of the compression chambers 39 is shifted to the central portion of both scroll units 2 and 4, the compressed refrigerant gas is discharged from the compression chambers 39 toward the discharge chamber 13 via the outlet port 11 and the discharge valve 12.

Figure 15:
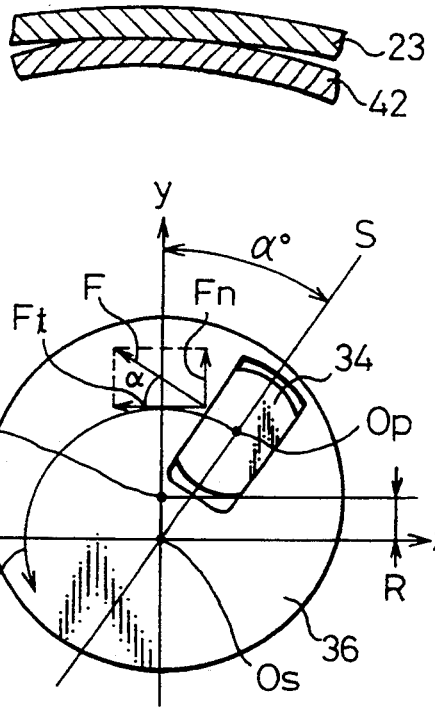
FIG. 15 is a diagrammatic view, illustrating the positional relationship between the drive key member of FIG. 11 and the drive bushing member of FIG. 13.

At this stage, it will be understood from FIG. 15 that when the scroll type refrigerant compressor is operated by the rotation of the drive shaft 33 in a direction designated by "M", a force "F" is exerted by the drive shaft 33 via the drive key member 34 which acts in a direction perpendicular to the diametrical axis "S" of the drive key member 34 on the rotating side of the drive shaft 33. The counterweight 35 acts so as to absorb dynamic unbalance of the movable scroll unit 4 to thereby prevent the unit 4 from vibrating. Namely, the counterweight 35 compensates for a moment of eccentricity which is given by the movable scroll unit 4 to the drive bushing member 36. Therefore, no centrifugal force acts on the drive key member 34 of the drive shaft 33. Thus, the drive bushing member 36 and the counterweight 35 perform only a limited amount of sliding movement along the diametrical axis "S" of the drive key member 34 by the guide of the planar faces **34*b* of the member 34. Namely, when the above-mentioned drive force "F" is divided into two component forces, i.e., a force component "Ft" parallel to the X-axis (the tangential line "l"), and a force component "Fn" normal to the tangential line "l", the force component "Ft" ($=F\times\cos\alpha$) acts so as to counterbalance a reacting force of compression of the refrigerant gas which is applied to the drive bushing member 36 by the movable scroll unit 4**.

It should be understood that although the counterweight 35 may counterbalance the centrifugal force acting on the movable scroll unit 4, the drive force "F" is applied by the drive shaft 33 to the drive bushing member 36 via the drive key member 34 at a point distant from the central axis "Ob" in a direction angularly shifted from the X-axis and Y-axis of the orthogonal coordinate system, irrespective of the rotating speed of the drive shaft 33. Namely, the drive force "F" has the force component "Fn" as clearly shown in FIG. 15. The force component "Fn" of the drive force "F" urges the drive bushing member 36 to slide in a direction increasing the eccentricity of the drive bushing member 36 from an initial predetermined amount "R" to an increased value "$R+(\Delta\times\cos\alpha)$" as will be understood from the illustration of FIG. 14. Accordingly, the radius of the orbiting motion of the drive bushing member 36 together with the movable spiral member 42 of the movable scroll unit 4 is increased. To this end, the movable spiral member 42 is radially urged toward the stationary spiral member 23 of the stationary scroll unit 2 (FIG. 15) to thereby ensure airtight sealing of the compression chambers 39 in the radial direction.

Further, the drive bushing member 36 is allowed to slidably move in a direction reducing the amount of the eccentricity thereof from the initially determined amount "R" to a reduced amount "$R-(\Delta\times\cos\alpha)$" against the above-mentioned force component "Fn". Therefore, the drive bushing member 36 can absorb a minute discrepancy in the engagement of the stationary and movable scroll units 2 and 4. Moreover, the strong damaging engagement of the stationary and movable spiral members 23 and 42 of the stationary and movable scroll units 2 and 4 due to a sudden reversal in the direction of rotation which may be caused by a stopping of the compressor or intrusion of foreign matter into the interior of the compressor can be avoided by the sliding of the drive bushing member 36 in a direction reducing the eccentricity thereof with regard to the axis of rotation of the drive shaft 33. Thus, the scroll type compressor in which the drive shaft 33 having the columnar-like drive key member 34 according to the above-described second embodiment may operate in such a manner that the airtight sealing of the compression chambers 39 defined between the stationary scroll unit 2 and the movable scroll unit 4 is constantly maintained irrespective of the rotating speed of the drive shaft 33, and accordingly a high compression efficiency of the compressor can be ensured. Further, the operating life of the mutually engaged stationary and movable spiral members 23 and 42 of the stationary and movable scroll units 2 and 4 can be ensured. In addition, since the drive key member 34 of the drive shaft 33 can be easily designed and manufactured in comparison with the drive key member of the prior art, reduction of the manufacturing cost of the scroll type refrigerant compressor per se may be achieved according to the second embodiment of the present invention.

Figure 16:
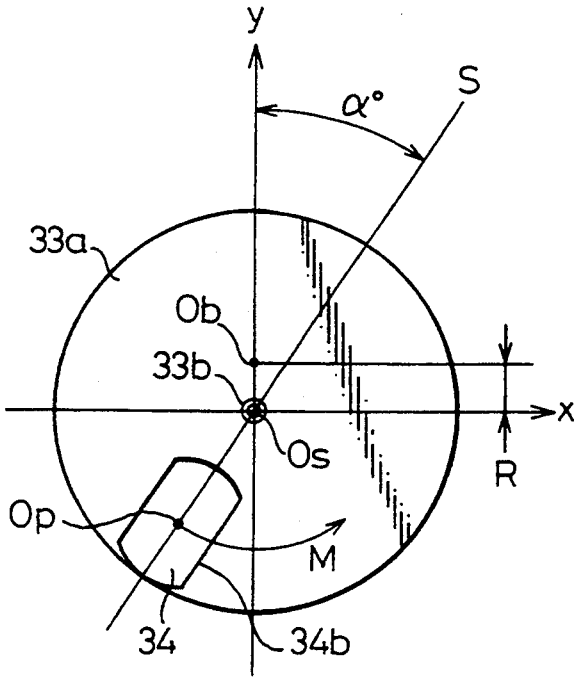
FIG. 16 is a schematic front view of a drive shaft provided with a drive key member according to a third embodiment of the present invention.

FIG. 16 illustrates a third embodiment of the present invention in which the drive key member 34 is formed in the inner end face **33*a* of the drive shaft 33 in such a manner that the central axis "Op" of the drive key member 34 is positioned on the diametrical axis "S" at a portion thereof which extends in the third quadrant of the orthogonal coordinate system having the X-axis and Y-axis. The other arrangement and construction of the drive shaft 33 is the same as those of the second embodiment. Namely, the drive key member 34 is provided with a pair of parallel planar faces 34*b* which are formed to be symmetrical with respect to and parallel with the axis "S". Therefore, the drive key member 34 of the drive shaft 33 permits the drive bushing member 36 and the counterweight 35 to slide in the direction corresponding to the diametrical axis "S" to thereby adjustably change the radius "R" of the orbiting motion of the movable scroll unit 4 against the stationary scroll unit 2**.

Further, the drive key member 34 is provided with radially inner and outer cylindrical faces connecting the two planar faces 34b, and the inner cylindrical face is spaced apart from the axis of rotation "Os" of the drive shaft 33. Accordingly, the center hole 33b is surely formed coaxially with the axis of rotation "Os" of the drive shaft 33. Thus, the drive key member 34 can be easily formed similarly to the case of the second embodiment.

Figure 17:
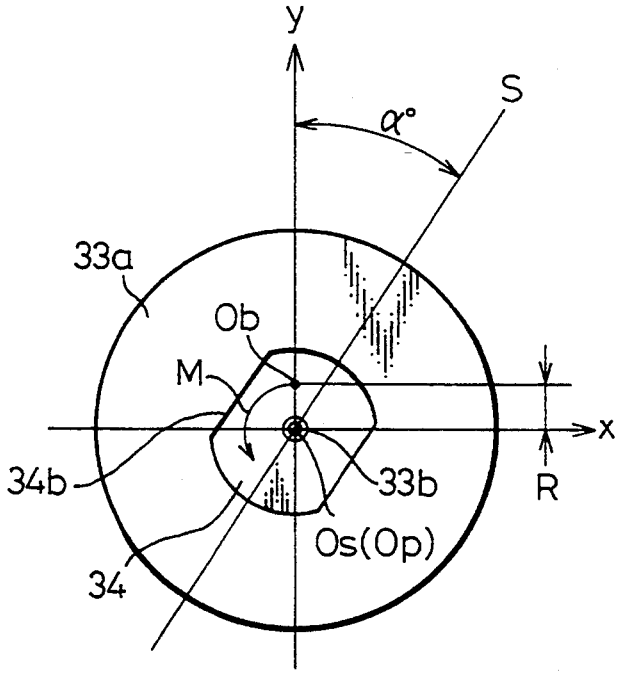
FIG. 17 is a schematic front view of a drive shaft provided with a drive key member according to a fourth embodiment of the present invention.

FIG. 17 illustrates a fourth embodiment of the present invention in which the drive key member 34 is formed centrally in the inner end face 33a of the large diameter portion of the drive shaft 33. Namely, the central axis "Op" of the drive key member 34 is arranged so as to be coaxial with the axis of rotation "Os" of the drive shaft 33. The center hole 33b is therefore bored in the center of the end face of the drive key member 34 as well as in the center of the inner end face 33a of the large diameter portion of the drive shaft 33. The drive key member 34 is provided with a pair of parallel planar faces 34b arranged to be parallel with the diametrical axis "S" thereof. Accordingly, the drive key member 34 of the third embodiment can permit the sliding of the drive bushing member 36 and the counterweight 35 so as to adjustably change the radius "R" of the orbiting motion of the movable scroll unit 4 (FIG. 1).

The arrangement of the center hole 33b coaxial with the axis of rotation "Os" of the drive shaft 33 and the central axis "Op" of the drive key member 34 makes it very easy to manufacture the drive key member 34. Since the center hole 33b used for forming the drive key member 34 is arranged in the center of the drive key member 34 per se, the outer circumference of the drive key member 34 does not interfere with the center hole 33b irrespective of the size of the key member 34. Thus, it is possible to form a large drive key member 34 in the inner end face of the drive shaft 33 which has a large mechanical durability. The possibility of forming large drive key member 34 contributes to forming a large planar faces 34b thereof, and accordingly, a large drive force "F" can be transmitted to the drive bushing member 36.

From the foregoing description of the preferred embodiments of the present invention, it will be understood that the scroll type refrigerant compressor in which the drive shaft having the drive key member according to the present invention is able to ensure the airtight sealing of the compression chambers defined between the stationary and movable scroll units. Thus, a high compression efficiency of the scroll type compressor can be obtained while guaranteeing the long operating life of the stationary and movable spiral members of the scroll units. Further, the easy forming of the drive key member of the drive shaft according to the present invention can contribute to mass production of many low cost scroll type refrigerant compressors.

It should be understood that many variations and modifications will occur to persons skilled in the art without departing from the spirit and scope of the present invention as claimed in the accompanying claims.

We claim:

1. A scroll type refrigerant compressor adapted for use in, for example, a vehicle refrigerating system, comprising:

an axial housing means forming an outer casing of the compressor and defining a refrigerant suction passage means, a discharge chamber and a compression organizing chamber receiving therein a compressing means, said housing means having an axis thereof extending axially at a substantially center portion thereof;

a stationary scroll means stationarily encased in said housing means and including a stationary spiral member and a stationary end plate member attached to an end of said spiral member;

a movable scroll means engaged with said stationary scroll means and moving along a predetermined orbiting path with respect to said stationary scroll means to thereby define compression chambers between both scroll means;

a drive shaft supported in said housing means via a bearing means so as to be rotated about an axis of rotation thereof, and having an axial shaft portion and a large diameter portion formed at an innermost portion of said axial shaft portion;

a drive key member projecting from an end of said large diameter portion of said drive shaft; and, a drive bushing member slidably engaged with said drive key member of said drive shaft and having a central axis thereof parallel with the axis of rotation of said drive shaft, said drive bushing member operatively engaged with said spiral member of said movable scroll means via a bearing means so as to drive said movable scroll means to move along the predetermined orbiting path in cooperation with means for preventing rotation of said movable scroll means about its own central axis during rotation of said drive shaft, and;

said stationary scroll means, said movable scroll means, said axial drive shaft, said drive key member, and said drive bushing member forming said compressing means successively for compressing the refrigerant gas in said compression chambers;

wherein said drive key member is formed as an axial columnar mechanical member having a central axis thereof parallel with the axis of rotation of said drive shaft and a diametrical axis thereof intercrossing the central axis of the drive key member at a predetermined point, said diametrical axis of said drive key member being arranged so as to intercross the axis of rotation of the drive shaft and be angularly shifted by a predetermined angle in a direction reverse to a rotating direction of said drive shaft with regard to a predetermined axis passing through the axis of rotation of said drive shaft, said predetermined point of said drive key member being arranged in an area extending in a direction reverse to the rotating direction of said drive shaft with regard to a line connecting the axis of rotation of said drive shaft and the central axis of said drive bushing member, said drive key member further having planar faces disposed on both sides of the diametrical axis thereof, and two spaced ends extending so as to interconnect between said planar faces, each of said two spaced ends being some distance from the central axis of said drive shaft.

2. A scroll type refrigerant compressor according to claim 1, wherein said predetermined axis further passes through said central axis of said drive bushing member, and is one orthogonal axes of an orthogonal coordinate system, and wherein said predetermined point lies in the first quadrant of said coordinate system.

3. A scroll type refrigerant compressor according to claim 1, wherein said predetermined axis further passes through said central axis of said drive bushing member, and is one orthogonal axes of an orthogonal coordinate system, and wherein said predetermined point lies in the third quadrant of said coordinate system.

4. A scroll type refrigerant compressor according to claim 1, wherein said predetermined axis further passes through said central axis of said drive bushing member, and is one orthogonal axes of an orthogonal coordinate system, and wherein said predetermined point lies at an origin of said coordinate system.

5. A scroll type refrigerant compressor adapted for use in, for example, a vehicle refrigerating system, which comprises:

an axial housing means forming an outer casing of the compressor and defining a refrigerant suction passage means, a discharge chamber and a compression organizing chamber receiving therein a compressing means, said housing means having an axis thereof extending axially at a substantially center portion thereof;

a stationary scroll means stationarily encased in said housing means and including a stationary spiral member and a stationary end plate member attached to an end of said spiral member;

a movable scroll means engaged with said stationary scroll means and moving along a predetermined orbiting path with respect to said stationary scroll means to thereby define compression chambers between both scroll means;

a drive shaft supported in said housing means via a bearing means so as to be rotated about an axis of rotation thereof, and having an axial shaft portion and a large diameter portion formed at an innermost portion of said axial shaft portion;

a drive key member projecting from an end of said large diameter portion of said drive shaft; and, a drive bushing member slidably engaged with said drive key member of said drive shaft and having a central axis thereof parallel with said axis of rotation of said drive shaft, said drive bushing member operatively engaged with said spiral member of said movable scroll means via a bearing means so as to drive said movable scroll means to move along the predetermined orbiting path in cooperation with means for preventing rotation of said movable scroll means about its own central axis during rotation of said drive shaft, and;

said stationary scroll means, said movable scroll means, said axial drive shaft, said drive key member, and said drive bushing member forming said compressing means successively compressing said refrigerant gas in said compression chambers;

wherein said drive key member is formed as an axial columnar mechanical member having a central axis thereof parallel with said axis of rotation of said drive shaft and a diametrical axis thereof intercrossing said central axis of said drive key member at a predetermined point, said diametrical axis of said drive key member intercrossing the axis of rotation of the drive shaft and being angularly shifted by a predetermined angle in a direction reverse to said rotating direction of said drive shaft with regard to a predetermined axis passing through said central axis of said drive shaft, said predetermined point of said drive key member being arranged at a point where said diametrical axis and a line tangential with a predetermined circle having a radius corresponding to a distance between said central axis of said drive shaft and said central axis of said drive bushing member, said tangential line intercrossing said central axis of said drive bushing member, said drive key member being provided with planar faces arranged on both sides of said diametrical axis thereof.

* * * * *